US011691374B2

(12) United States Patent
Goodrich

(10) Patent No.: US 11,691,374 B2
(45) Date of Patent: Jul. 4, 2023

(54) EXPANSION SYSTEM FOR IMPROVED HANDLING AND AVOIDANCE OF DAMAGE AND/OR CRUSHING OF EXPANDABLE SLIT SHEET PAPER

(71) Applicant: David Paul Goodrich, Sedona, AZ (US)

(72) Inventor: David Paul Goodrich, Sedona, AZ (US)

( * ) Notice: Subject to any disclaimer, the term of this patent is extended or adjusted under 35 U.S.C. 154(b) by 461 days.

(21) Appl. No.: 16/749,875

(22) Filed: Jan. 22, 2020

(65) Prior Publication Data

US 2020/0230908 A1 Jul. 23, 2020

Related U.S. Application Data

(60) Provisional application No. 62/795,310, filed on Jan. 22, 2019.

(51) Int. Cl.
*B31D 1/00* (2017.01)
*B31D 5/00* (2017.01)

(52) U.S. Cl.
CPC ..... *B31D 1/0031* (2013.01); *B31D 5/0065* (2013.01); *B31D 2205/0017* (2013.01)

(58) Field of Classification Search
CPC ..... B31D 1/0031; B31D 5/0065; B31D 2205/0017; B31D 5/0039; B31D 2205/0005; B31D 3/00; B31D 3/002; B31D 3/02; B31D 3/04; B31D 5/0043
USPC ..... 428/136
See application file for complete search history.

(56) References Cited

U.S. PATENT DOCUMENTS 5,151,151 A * 9/1992 Kao ..... E06B 9/262 425/336
5,538,778 A 7/1996 Hurwitz et al.
5,688,578 A * 11/1997 Goodrich ..... B31D 5/0069 428/184
5,782,735 A * 7/1998 Goodrich ..... B31D 1/0031 83/175

(Continued)

FOREIGN PATENT DOCUMENTS

WO 96/01731 A1 1/1996
WO 2015/035335 A1 3/2015

OTHER PUBLICATIONS

International Search Report dated Apr. 21, 2020, issued in counterpart Application No. PCT/US2019/014649 (17 pages).

(Continued)

*Primary Examiner* — Sameh Tawfik
(74) *Attorney, Agent, or Firm* — Studebaker & Brackett, PC

(57) ABSTRACT

In some illustrative embodiments of the present invention, a novel expandable slit paper expansion device design is provided that, among other things, avoid complications of prior systems and eliminates the crushing effect of the rollers. Among other things, the preferred embodiments provide a unique structure that provides a novel "S" shape path of the expandable slit sheet paper, such that the expandable slit sheet paper is tortuously weaved between at least two expansion rollers without being compressed therebetween, in a manner that the expandable slit sheet paper follows along surfaces of the expansion rollers without pinching or compression that occurs in the background art.

38 Claims, 9 Drawing Sheets

(56) References Cited

U.S. PATENT DOCUMENTS

| | | | | |
|---|---|---|---|---|
| 9,005,096 | B2 * | 4/2015 | Kling | B65H 45/228 493/356 |
| 10,081,153 | B2 * | 9/2018 | Kling | B31D 5/04 |
| 10,773,839 | B1 * | 9/2020 | Talda | B65B 61/28 |
| 2010/0065984 | A1 * | 3/2010 | Akaki | D06C 3/06 264/288.4 |
| 2011/0042849 | A1 * | 2/2011 | Akaki | B29C 55/18 264/288.4 |
| 2011/0309125 | A1 * | 12/2011 | Kuchar | B31D 3/002 226/195 |
| 2017/0203866 | A1 * | 7/2017 | Goodrich | B31D 5/0069 |
| 2017/0313017 | A1 | 11/2017 | Cheich et al. | |

OTHER PUBLICATIONS

The Extended European Search Report issued by the European Patent Office dated Sep. 22, 2022, which corresponds to European Application No. 20744692.3-1014 and is related to U.S. Appl. No. 16/749,875.

* cited by examiner

EXPANSION SYSTEM FOR IMPROVED HANDLING AND AVOIDANCE OF DAMAGE AND/OR CRUSHING OF EXPANDABLE SLIT SHEET PAPER

This application is a non-provisional of and claims priority to U.S. Provisional Application No. 62/795,310 filed on Jan. 22, 2019, entitled Expansion System for Non-Crushing Slit Sheet, by David Paul Goodrich.

BACKGROUND

Field of the Invention

The preferred embodiments of the present invention relate to systems and methods for improved expansion of an expandable slit sheet material.

Description of the Background

The preferred embodiments improve upon and overcome a number of issues in relation to existing background art.

Among other things, the preferred embodiments of the present invention substantially improve upon that shown in the present inventor's prior U.S. Pat. No. 5,688,578, entitled Slit Sheet Packing Material, which teaches the use of an expansion device that uses a pair of hook and loop rollers, using the hook portion of material such as sold under the trademark Velcro®. In this background patent, the pair of rollers are vertically aligned in the machine direction (i.e., the expansion direction of the expanded slit sheets) and spaced apart such that the rollers grab and pull through the expanded slit sheet by grabbing both sides of the expanding slit sheet. It has now been found by the present inventor that this method, particularly for a single slit sheet expansion, crushes the sheet as it is pulled through. This crushing reduces the overall effectiveness of the expanded slit sheet, such as, e.g., reducing its effectiveness as a cushioning material. It has now also been determined by the present inventor, through testing, that although the resultant crushing was not previously evident, it does occur and reduces the overall effectiveness of the expanded slit sheet as a cushioning material. The disclosure of U.S. Pat. No. 5,688,578 is incorporated herein by reference, as though recited in full.

The present invention is also a substantial improvement over the present inventor's prior U.S. Patent Publication No. 2017/0203866 that involves a pair of opposing hook rollers that expand a layered pair opposing slit sheets that together pass between the opposing hook rollers, wherein the opposing hook rollers are, similar to the above U.S. Pat. No. 5,688,578, vertically aligned at the same location in the machine direction (i.e., in the expansion direction of the expanded slit sheets).

The preferred embodiments provide substantial improvements over the above and/or other background art, and overcome a number of issues in relation to the above and/or other background art.

SUMMARY

The preferred embodiments of the present invention overcome various shortcomings in the background art.

In accordance with some illustrative embodiments of the present invention, a novel expandable slit paper expansion device design is provided that, among other things, avoid complications of prior systems and eliminates the crushing effect of the rollers. Among other things, the preferred embodiments provide a unique structure that provides a novel "S" shape path of the expandable slit sheet paper, such that the expandable slit sheet paper is tortuously weaved between at least two expansion rollers without being compressed there-between, in a manner that the expandable slit sheet paper follows along surfaces of the expansion rollers without pinching or compression that occurs in the background art.

Among other things, the present invention provides a novel and advantageous configuration that, e.g., improves handling of expandable slit sheet paper and avoids damage, such as, e.g., crushing or the like.

According to some preferred embodiments of the invention, a system having an expander for expanding and feeding an expandable slit sheet material with reduced damage to the expandable slit sheet material is provided that includes: a) at least one first roller for feeding the expandable slit sheet material, the at least one first roller being adapted to rotate to move the expandable slit sheet material downstream at a first reduced rate; b) at least two expansion rollers located downstream from the at least one first roller which receive the expandable slit sheet material from the at least one first roller, the at least two expansion rollers being adapted to rotate to move the expandable slit sheet material further downstream at a second rate that is faster than the first reduced rate, such as to cause the expandable slit sheet material to expand due to the second rate being faster than the first reduced rate; c) the at least two expansion rollers including two adjacent expansion rollers arranged to adjacent one another, at least one of the two adjacent expansion rollers including a plurality of hooks distributed around a periphery thereof which are configured to engage slits of the expandable slit sheet material; d) the two adjacent expansion rollers being separated from one another by a distance greater than a thickness of the expandable slit sheet material in an expanded state, such that the two adjacent expansion rollers do not concurrently press against opposite sides of the expanded slit sheet material at a same longitudinal position of the expanded slit sheet material so that the two adjacent expansion rollers avoid damaging the expanded slit sheet material.

According to some exemplary embodiments, the two adjacent expansion rollers are arranged such that a portion of the path of the expanded slit sheet material passing around the two adjacent expansion rollers is S-shape, with the path curving in a first direction around a periphery of one of the two adjacent expansion rollers and then in a second direction that is away from the first direction around a periphery of the other of the two adjacent rollers.

According to some exemplary embodiments, the system is an envelope manufacturing system.

According to some exemplary embodiments, the system is configured to manufacture an envelope having the expanded slit sheet material in a peripheral wall of the envelope for protection of an item within the envelope.

According to some other preferred embodiments, a method of using the system of according to the above preferred embodiment(s) is performed that includes: manufacturing a plurality of envelopes each having expanded slit sheet material in a peripheral wall of the envelope for protection of items within the envelope.

According to some exemplary embodiments, the system is a wrapping system.

According to some exemplary embodiments, the system is configured to provide wrapping of an item within the expanded slit sheet material for protection of the item.

According to some other preferred embodiments, a method of using the system according to the above preferred embodiment(s) is performed that includes: wrapping an item with the expanded slit sheet material for protection of the item.

According to some exemplary embodiments, the system further includes a controller for controlling the rotation of the at least two expansion rollers.

According to some exemplary embodiments, the two adjacent expansion rollers are separated from one another by a distance greater than the thickness of the expandable slit sheet material and up to 140% of the thickness. According to some exemplary embodiments, the two adjacent expansion rollers are separated from one another by a distance greater than the thickness of the expandable slit sheet material and up to 160% of the thickness. According to some exemplary embodiments, the two adjacent expansion rollers are separated from one another by a distance greater than the thickness of the expandable slit sheet material and up to 180% of the thickness. According to some exemplary embodiments, the two adjacent expansion rollers are separated from one another by a distance greater than the thickness of the expandable slit sheet material and up to 200% of the thickness. According to some exemplary embodiments, the two adjacent expansion rollers are separated from one another by a distance greater than the thickness of the expandable slit sheet material and up to 240% of the thickness. According to some exemplary embodiments, the two adjacent expansion rollers are separated from one another by a distance greater than the thickness of the expandable slit sheet material and up to 260% of the thickness. According to some exemplary embodiments, the two adjacent expansion rollers are separated from one another by a distance greater than the thickness of the expandable slit sheet material and up to 300% of the thickness.

According to some exemplary embodiments, the two adjacent expansion rollers are arranged such that the path of the expanded slit sheet material passing around each of the two adjacent expansion rollers includes the expanded slit sheet material contacting each of the two adjacent expansion rollers around respective arcs of at least 40 degrees around each of the adjacent expansion rollers. According to some exemplary embodiments, the two adjacent expansion rollers are arranged such that the path of the expanded slit sheet material passing around each of the two adjacent expansion rollers includes the expanded slit sheet material contacting each of the two adjacent expansion rollers around respective arcs of at least 60 degrees around each of the adjacent expansion rollers. According to some exemplary embodiments, the two adjacent expansion rollers are arranged such that the path of the expanded slit sheet material passing around each of the two adjacent expansion rollers includes the expanded slit sheet material contacting each of the two adjacent expansion rollers around respective arcs of at least 90 degrees around each of the adjacent expansion rollers. According to some exemplary embodiments, the two adjacent expansion rollers are arranged such that the path of the expanded slit sheet material passing the one of the two adjacent expansion rollers includes the expanded slit sheet material contacting the one of the two adjacent expansion rollers around an arc of between 180 degrees and 270 degrees. According to some exemplary embodiments, the two adjacent expansion rollers are arranged such that the path of the expanded slit sheet material passing the other of the two adjacent expansion rollers includes the expanded slit sheet material contacting the other of the two adjacent expansion rollers around an arc of between 180 degrees and 270 degrees.

According to another preferred embodiment, a system having an expander for expanding and feeding an expandable slit sheet material with reduced damage to the expandable slit sheet material is provided that includes: a) a feeder that feeds or allows feeding of the expandable slit sheet material downstream; b) at least two expansion rollers located downstream from the feeder which receive the expandable slit sheet material from the feeder, the at least two expansion rollers being adapted to rotate to move the expandable slit sheet material further downstream at a faster rate than a rate of the expandable slit sheet material proximate the feeder, such as to cause the expandable slit sheet material to expand due to the increased faster rate; c) the at least two expansion rollers including two expansion rollers arranged such as to be separated in a longitudinal feeding direction of the expandable slit sheet material, at least one of the two adjacent expansion rollers including a plurality of hooks distributed around a periphery thereof which are configured to engage slits of the expandable slit sheet material; d) the two adjacent expansion rollers being separated from one another in the longitudinal feeding direction of the expandable slit sheet material by a distance greater than a thickness of the expandable slit sheet material in a fully expanded state, such that the two adjacent expansion rollers do not concurrently press against opposite sides of the expanded slit sheet material at a same longitudinal position of the expanded slit sheet material so that the two adjacent expansion rollers avoid damaging the expanded slit sheet material.

According to some exemplary embodiments, the feeder includes a first feeding roll that is adapted to rotate at a reduced rate (in some other embodiments, the feeder can include a non-rotated bar around which the extendable paper passes in feeding downstream and/or another feeding mechanism that actively or passively directs or allows the expandable sheet to be fed downstream).

According to some exemplary embodiments, the two adjacent expansion rollers are arranged such that a portion of the path of the expanded slit sheet material passing around the two adjacent expansion rollers is S-shape, with the path curving in a first direction around a periphery of one of the two adjacent expansion rollers and then in a second direction that is away from the first direction around a periphery of the other of the two adjacent rollers.

According to some exemplary embodiments, the distance is greater than ½ inch.

According to some exemplary embodiments, the distance is greater than 4 inches.

According to some exemplary embodiments, the distance is greater than 6 inches.

According to some exemplary embodiments, the system is an envelope manufacturing system.

According to some exemplary embodiments, the system is configured to manufacture an envelope having the expanded slit sheet material in a peripheral wall of the envelope for protection of an item within the envelope.

According to some exemplary embodiments, the at least one of the two adjacent expansion rollers including a plurality of hooks distributed around a periphery thereof which are configured to engage slits of the expandable slit sheet material includes an upstream-most one of the two adjacent expansion rollers.

According to some exemplary embodiments, the two adjacent expansion rollers are arranged such that the path of the expanded slit sheet material passing around each of the two adjacent expansion rollers includes the expanded slit sheet material a most upstream one of the two adjacent expansion rollers around an arc of at least 40 degrees therearound.

According to some exemplary embodiments, the two adjacent expansion rollers are arranged such that the path of the expanded slit sheet material passing around each of the two adjacent expansion rollers includes the expanded slit sheet material contacting a most upstream one of the two adjacent expansion rollers around an arc of at least 60 degrees therearound.

According to some exemplary embodiments, the two adjacent expansion rollers are arranged such that the path of the expanded slit sheet material passing around each of the two adjacent expansion rollers includes the expanded slit sheet material a most upstream one of the two adjacent expansion rollers around an arc of at least 90 degrees therearound.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF DRAWINGS

The preferred embodiments of the present invention are shown, by way of example, in the accompanying drawings, in which.

DESCRIPTION OF THE PREFERRED EMBODIMENTS

Figure 1:
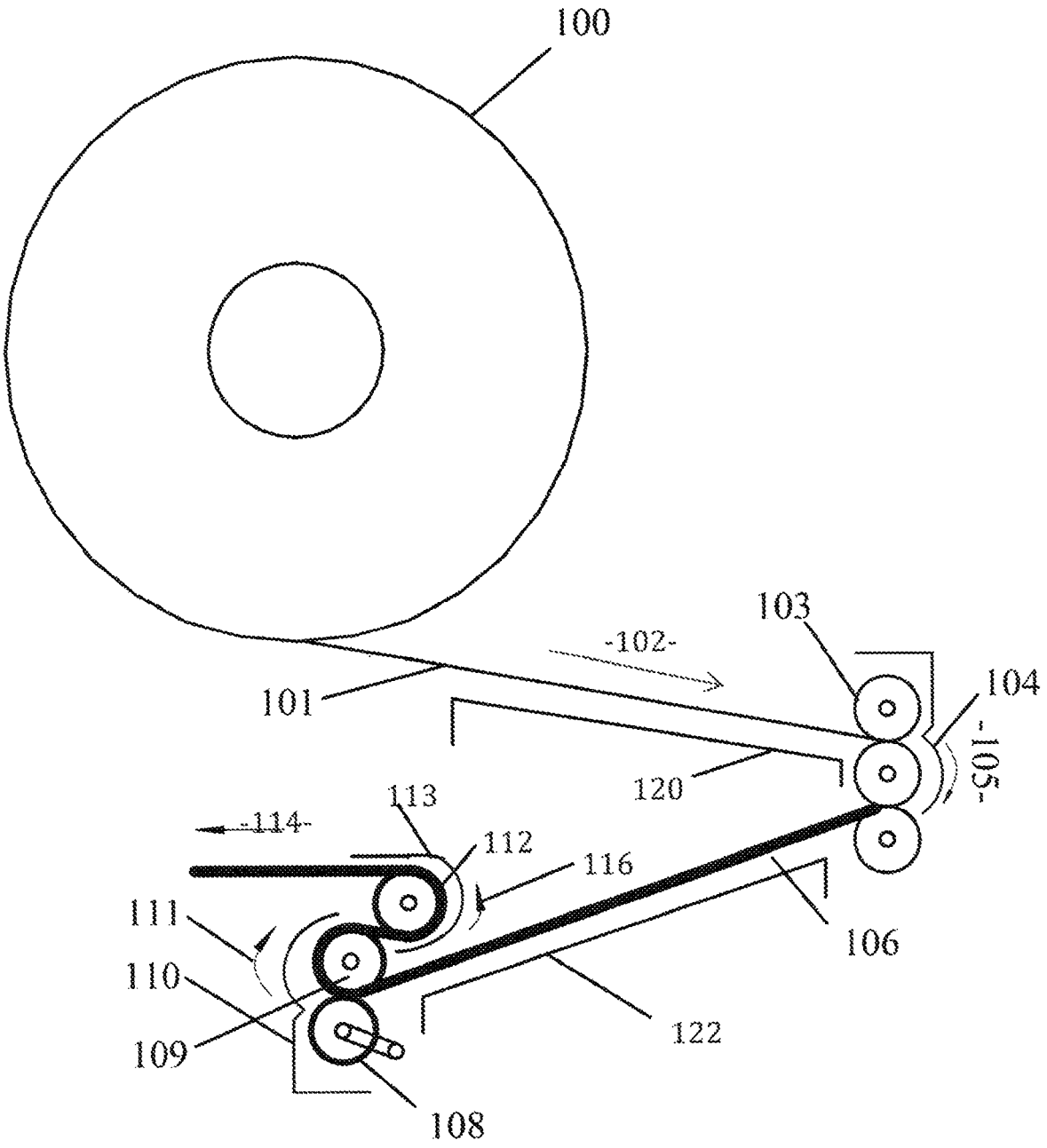
FIG. 1 is a side view of an illustrative embodiment of the invention employing expansion rollers configured to create an "S" pattern, with the expansion rollers in a loading configuration.

While the present invention may be embodied in many different forms, the illustrative embodiments are described herein with the understanding that the present disclosure is to be considered as providing examples of the principles of the invention and that such examples are not intended to limit the invention to preferred embodiments described herein and/or illustrated herein.

Definitions

Where the definition of terms departs from the commonly used meaning of the term, applicant intends to utilize the definitions provided below, unless specifically indicated otherwise.

In some of the preferred embodiments of the present invention, hooks of hook and loop fastening systems are employed. In the context of such preferred embodiments of the present invention, the term "hook" encompasses (i.e., includes) a hook portion of a hook and loop combination that encompasses the hook and loop system. In that regard, a hook is the portion that can grab the expanded slit sheet and the expanded sheet acts as the loop.

Hook-and-loop fasteners and hook-and-pile fasteners have been used with clothes and a wide variety of other items and applications. In some existing hook and loop fasteners, the fasteners include two thin plastic strips or sheets, one covered with tiny loops and the other with tiny flexible hooks. In use, when the two strips or sheets are pressed together, the flexible hooks engage with the tiny loops, adhering the two strips or sheets together. Then, the two strips or sheets can be separated by pulling apart the strips or sheets such as to disengage the hooks from the loops. Thus, hook-and-loop fasteners and hook-and-pile fasteners generally contain two components: typically, two lineal fabric strips which are attach together by hooking one strip to the opposing surfaces of the other strip. The first component featuring a multitude of tiny hooks distributed on a surface of, the second features smaller loops.

In some illustrative embodiments, hooks employed in some embodiments of the present invention can include features as described in any of the following patents and publications, the entire disclosures of which are all incorporated herein by reference:

1. U.S. Pat. No. 5,339,499 (detailing, e.g., hook design for a hook and loop fastener, and background hook structures that can also be employed in some embodiments);
2. U.S. Pat. No. 9,259,060 (detailing, e.g., mushroom-type hook strap for mechanical fasteners);

3. U.S. Pat. No. 10,064,453 (detailing, e.g., molded surface fastener);
4. U.S. Patent Publication No. 2003/0106188 (detailing, e.g., fasteners engageable with loops of non-woven fabrics and with other open structures, and method and machines for making fasteners);
5. U.S. Patent Publication No. 2017/0203866 (detailing, e.g., illustrative hook structure that engage slits in two layers of opposing slit sheet material that passes between a pair of opposing hook rollers); and
6. EP 1,395,136 (detailing, e.g., methods of forming fasteners).

For the purposes of the present invention, the term "S" shape means a double curve in the path of the expandable paper that forms a shape generally similar to the letter "S" or generally similar to a backwards letter "S" (e.g., 2). However, the terminology S shape does not suggest any particular degree of curvature or any particular similarity to a letter S. Notably, as long as at least a portion of the path of the expandable paper curves first in one direction and then in an opposite direction, it is within the scope of this terminology S shaped. The terms "S shape" and "S curve" and "S pattern" are employed herein as synonyms. In an S curve paper path, a line between the axis of a first hook roller to the axis of the second hook roller intersects with the path of the expandable paper in a region of the expandable paper between the first and second hook rollers at an acute angle. The region of the expandable paper between the first and second hook rollers is a region that extends from a first point where the expandable slit paper tangentially leaves the first hook roller to a second point where the expandable slit paper tangentially contacts the second hook roller. Furthermore, the terminology S shape or S curve, while meaning a double curve as discussed above, is not limited to and does not require just two curves; the system can include additional curves, as long as the double curve is included. For example, some embodiments can have three or more curves.

For the purposes of the present invention, the term "hook" encompasses any member that is capable of hooking, catching or grabbling slits within an expandable slit paper, and a "hook" encompasses, for example, a tine, prong and/or spike, that is arranged to extend from the hook roller and shaped to spear, hook, catch, and/or grab an edge of a slit. In the preferred embodiments, such tine, prong and/or spike, would include a narrow elongated base portion (e.g., a shaft portion) and a laterally extending distal portion (e.g., a curved tip, a bent tip, a barb, an enlarged head portion, etc.). In the preferred embodiments, the hooks of the hook rollers are configured to engage the slits of the expandable paper, and, in such an engaged state, to move the expanded or expanding slit paper by pulling the slit sheet paper as the hook roller rotates. In the preferred embodiments, such hooks, tines, prongs and/or spikes, having, e.g., barbed tips for engaging edges of expanding and expanded the expandable slit paper sheet to form, e.g., hexagonal cells that are formed in slit paper include flexible hooks, tines, prongs and/or spikes which are capable of flexibly engaging within the slits and flexibly disengaging with the slits in a similar manner to how common hook and loop fasteners have flexible hooks that are engageable and disengageable with corresponding loops.

Illustrative Expandable Slit Sheet Paper

Figure 11A:
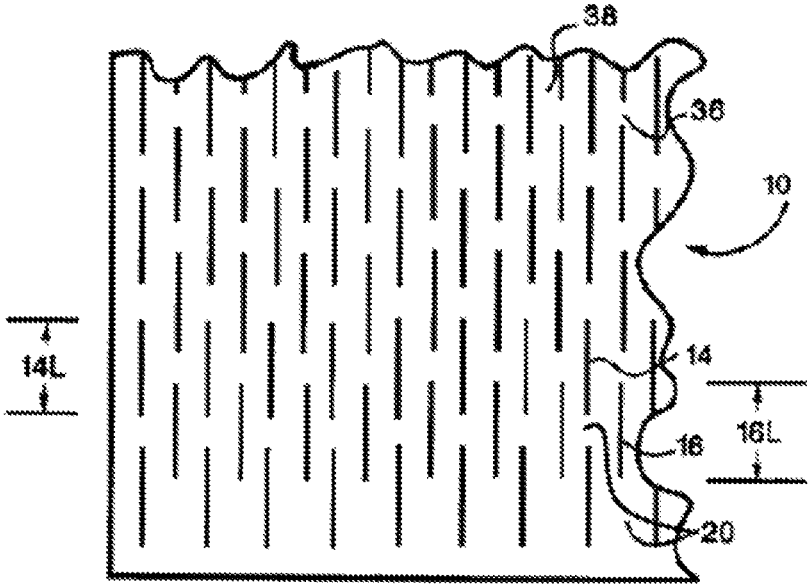
FIG. 11A is a plan view of an illustrative expandable slit sheet paper in an unexpanded state.
Figure 11B:
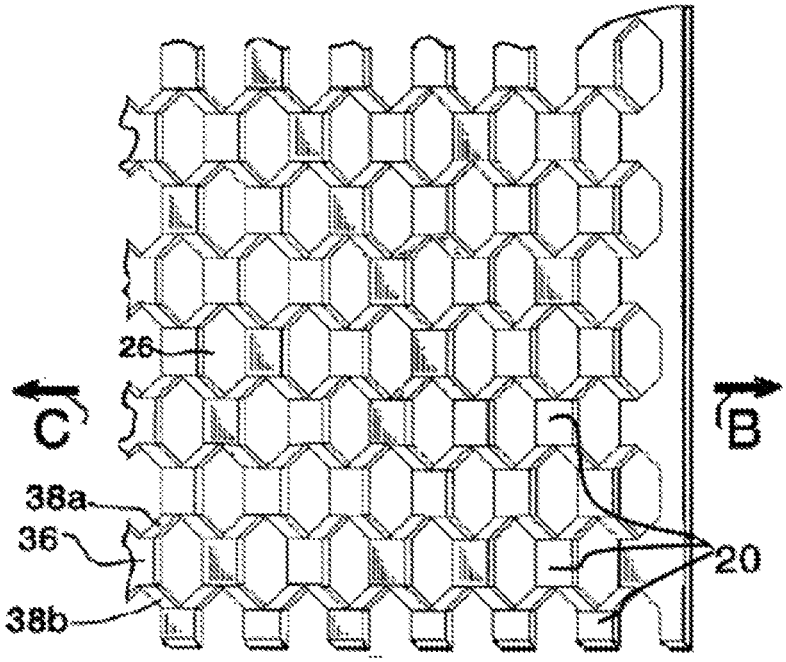
FIG. 11B is a plan view of the illustrative expandable slit sheet paper in an expanded state, which illustrative paper can be employed for expansion in illustrative embodiments of the present invention.

FIGS. 11A and 11B depict an illustrative expandable slit sheet paper that can be expanded with systems and methods of the present invention in some illustrative embodiments of the invention. Towards that end, FIG. 11A is an illustration of an exemplary slit pattern in an illustrative expanded slit sheet. The expandable slit sheet paper shown in FIG. 11A operates as an expandable cell-forming paper that can be expanded to an expanded state as shown in FIG. 11B. FIG. 11A shows an illustrative section of an expandable slit sheet 10 in an unexpanded (unopened) state, with staggered rows of slits 14 and 16 that extend entirely through the width of the sheet 10, and land portions 20 extending between adjacent slits within rows 14 and 16. As shown in FIG. 11A, in some preferred embodiments, the slit lengths 14L and 16L are uniform across the face of the sheet 10; similarly, the distance and area of each row spacing 38 (i.e., between adjacent rows) and each slit spacing 36 (i.e., between adjacent slits) are also uniform. Although an expandable slit sheet can be formed with a variety of slit patterns, the illustrative example shown in FIGS. 11A and 11B depict an illustrative example to scale with illustrative lengths of slits, spacing between slits, proportional relationships of sizes of created hexagonal cells, land portions and leg portions, etc., according to some illustrative examples with such as drawings being to scale in some illustrative and non-limiting embodiments. In FIG. 11B, the sheet 10 shown in FIG. 11A has been subjected to an expansion force in the direction of arrows B and C and opened to an open cell formation. In that regard, in this illustrated example, the open cell formation results in hexagonal shaped cells as shown in FIG. 11B. In particular, as depicted, the slits 14 and 16 are in an opened state in which the sheet 10 is oriented to have an array of three-dimensional hexagonal cells 26, with substantially rectangular land portions 20 within the slit spacings 36 situated at an inclined angle (i.e., such as to be transverse to the original plane of the sheet 10), and the leg portions 38*a* and 38*b* connecting the land portions between the row spacings having been warped to, e.g., slightly less than a 90° angle to the original plane of the sheet. The leg portions 38*a* and 38*b* are basically mirror images of one another and connect the land portions 20 such as to form the three dimensional hexagonal cells.

As explained herein, in the preferred embodiments, systems and methods of the preferred embodiments of the present invention can be employed for expanding an expandable slit sheet similar to that shown in FIGS. 11A and 11B, in an optimal manner maintaining the quality and integrity of the expanded slit sheet, including avoiding crushing and/or otherwise damaging or compromising the expanded slit sheet and/or the manageability of the expanded slit sheet.

Description of Illustrative Systems and Methods

In some preferred embodiments, expansion rollers (e.g., hook rollers) work in conjunction with feeding rollers (e.g., a pair of rubber type pinch rollers) that operate preferably at a slower speed (e.g., about a 67 percent slower speed) than the expansion rollers (e.g., hook rollers). This speed differential causes the slit sheet to expand. Although the speed differential of 67 percent is employed in some illustrative embodiments, it should be appreciated that the speed differential can vary based on the degree of expandability of the expandable slit sheet paper. Accordingly, other embodiments can have different differential is speeds based on circumstances. By way of example, in some embodiments the differential can include the pinch rollers operating, e.g., between about 25 to 100 percent slower than the speed of the hook rollers (i.e., expansion rollers). However, as long as the expansion rollers (e.g., hook rollers) operate at a higher rate than the feeding rollers (e.g., pinch rollers) leading thereto, such as to effect expansion of the expandable slit sheet material, the speed differential can be appropriate under the circumstances.

The expansion process is a self-feeding mechanism whereby the material exits the expansion rollers (e.g., hook rollers) expanded on a continuous basis. Among other things, the use of a larger distance between the expansion rollers (e.g., hook rollers) than the thickness of the slit sheet expanded eliminates crushing while expanding and feeding the slit material outward.

In some preferred embodiments of the present invention, a new technology is provided that creates a tension between the rollers by forcing the paper to travel around a first hook roller and then, a short distance away, around a second hook roller. In preferred embodiments, a sharp "S" shaped turn maintains enough tension on both sides of the expanded slit sheet so that the expanded slit sheet does not slip backward towards the feeding rollers (e.g., rubber pinch rollers) which would cause the sheet to revert to becoming partly or fully unstretched and thus unexpanded.

In some embodiments, the non-crushing expansion roller (e.g., hook roller) system can be used for a plurality of purposes. For example, a first advantageous use is with an automatic machine at a packing station similar to that found in the background art (see U.S. Pat. No. 5,688,578 incorporated herein by reference in its entirety). Another exemplary use is in the manufacture of envelopes, and, most desirably, envelopes as described in provisional applications Nos. 62/712,867 and 62/714,739, filed on Jul. 31, 2018 and Aug. 5, 2018, respectively, and incorporated herein by reference as if recited in full, as well as described in co-pending U.S. application Ser. No. 16/531,017 filed on Aug. 3, 2019, the entire disclosure of which is also incorporated herein by reference.

In the case of the use for wrapping at a packing station, if the expansion rollers (e.g., hook rollers) are too far apart as to not create a tight S turn that is sufficient enough to maintain tension, then the expanded slit sheet could fall back (i.e., slip) when the paper is not being used to wrap material. If the paper does fall back, then the loading hook loader 108, as shown in FIG. 1, would have to be reengaged to reload the paper. To inhibit this slippage of the expanded slit sheet, the hook rollers are separated at the thickness or slightly greater than that of the expanded sheet. In that manner, the hook rollers do not compress or pinch the expanded slit sheet paper, but are close enough to inhibit slippage.

In some exemplary embodiments, a thickness of the expanded sheet is about 3/16"; in these exemplary embodiments, a preferable distance between the rollers would be at or about 3/16" to 1/4", or, in some other embodiments, up to about 1/2". In some less preferred embodiments with an expanded sheet having a thickness of about 3/16", the distance between the rollers can be greater, such as, e.g., up to about 2/3", or, even up to about 3/4" or even more. Although some embodiments of expanded slit sheet has a thickness of about 3/16" as noted above, it should be appreciated that other embodiments can have different thicknesses of the expanded slit sheet paper when in an expanded state. For example, in some examples, the thickness in the expanded state can be about 1/16"; or, in some examples, this thickness can be about 2/16"; or, in some examples, this thickness can be about 4/16"; or, in some examples, this thickness can be about 5/16"; or, in some examples, this thickness can be about 6/16"; or, in some examples, this thickness can be about 7/16"; or, in some embodiments, this thickness can be about 8/16"; or in some embodiments the thickness can be even greater. In such other embodiments, the distance between the rollers is preferably within a range proportional to the examples set forth above with respect to the 3/16" thickness examples.

In some embodiments, the distance between the adjacent rollers is the same as or, alternatively, approximately the same as the thickness of the expanded slit sheet material. In some other embodiments, the distance between the adjacent rollers is up to about 20% greater than the thickness of the expanded slit sheet material. In some other embodiments, the distance between the adjacent rollers is up to about 40% greater than the thickness of the expanded slit sheet material. In some other embodiments, the distance between the adjacent rollers is up to about 60% greater than the thickness of the expanded slit sheet material. In some other embodiments, the distance between the adjacent rollers is up to about 80% greater than the thickness of the expanded slit sheet material. In some other embodiments, the distance between the adjacent rollers is up to about 100% greater than the thickness of the expanded slit sheet material (i.e., up to about twice as large). In some other embodiments, the distance between the adjacent rollers is up to about 120% greater than the thickness of the expanded slit sheet material. In some other embodiments, the distance between the adjacent rollers is up to about 140% greater than the thickness of the expanded slit sheet material. In some other embodiments, the distance between the adjacent rollers is up to about 160% greater than the thickness of the expanded slit sheet material. In some other embodiments, the distance between the adjacent rollers is up to about 180% greater than the thickness of the expanded slit sheet material. In some other embodiments, the distance between the adjacent rollers is up to about 200% greater than the thickness of the expanded slit sheet material (i.e., up to about three times as large). In some other embodiments, the distance between the adjacent rollers is even greater, such as, e.g., up to about 300% or more.

In the preferred embodiments, the shape of the S turn would be such that the expanded sheet leaving the first roll would be perpendicular or slightly less than perpendicular providing an acute angle towards the next roller. The purpose is two-fold. The more acute the angle, the more the paper has to involve the radius of the roller prior to exiting.

FIG. 1 shows the slit paper flow from roller 109 to roller 112 provides less than 270 degrees of arcuate contact with the circumference of the roller 109 and then less than 180 degrees of contact with roller 112. Since alternate sides of the slit sheet are engaged by rollers 109 and 112, the ability for the hooks to maintain a positive non-slipping contact with the expanded sheet is optimized while maintaining the spacing required for ease of machinery design and construction.

It should also be noted that for the purposes of the drawings the exact tolerances, such as dimensions and clearances, of the paper guides are not illustrated in the drawings. The guides, as shown in FIGS. 1 (104, 110, 113, 120, and 122), would be much closer to the rollers than shown in the drawings so that the paper does not escape away from the intended direction in which it must go.

In the case of a continuous pulling of the expanded sheet, as found when making envelopes, then the critical placement of the hooks is less critical and would be spaced further apart and perpendicular for the purposes of easier paper loading. The use of the paper guides may or may not be necessary or preferable if other equipment interferes with the easy access to the non-crushing hooks system. In the most preferable design, the tolerances could be made the same as what was just described for the equipment used at the packing station.

Nevertheless, the concept of maintaining friction between two hook rollers based on their proximity and the resultant changing paper directions that create the S turns is very advantageous and enables providing the best cushioning available from expanded slit sheet material, equivalent to the manual system created by the inventor described in U.S. patent application Ser. No. 15/820,514 incorporated herein by reference, as if recited in full. Manual pulling of the expanded sheet eliminates the need for pre-expansion and eliminates the hook rollers and, therefore, avoids any crushing, creating a non-crushed expanded slit material that maximizes the value of its cushioning properties.

Paper guides and an additional hook roller facilitate an easy loading method for guiding the paper through the pinch roller and through to the S curve hook automatically to the rollers. When the paper has been loaded properly and is stretching and feeding consistently, the third hook roller 108 of FIG. 1 disengages.

Discussion of the Figures

Figure 2:
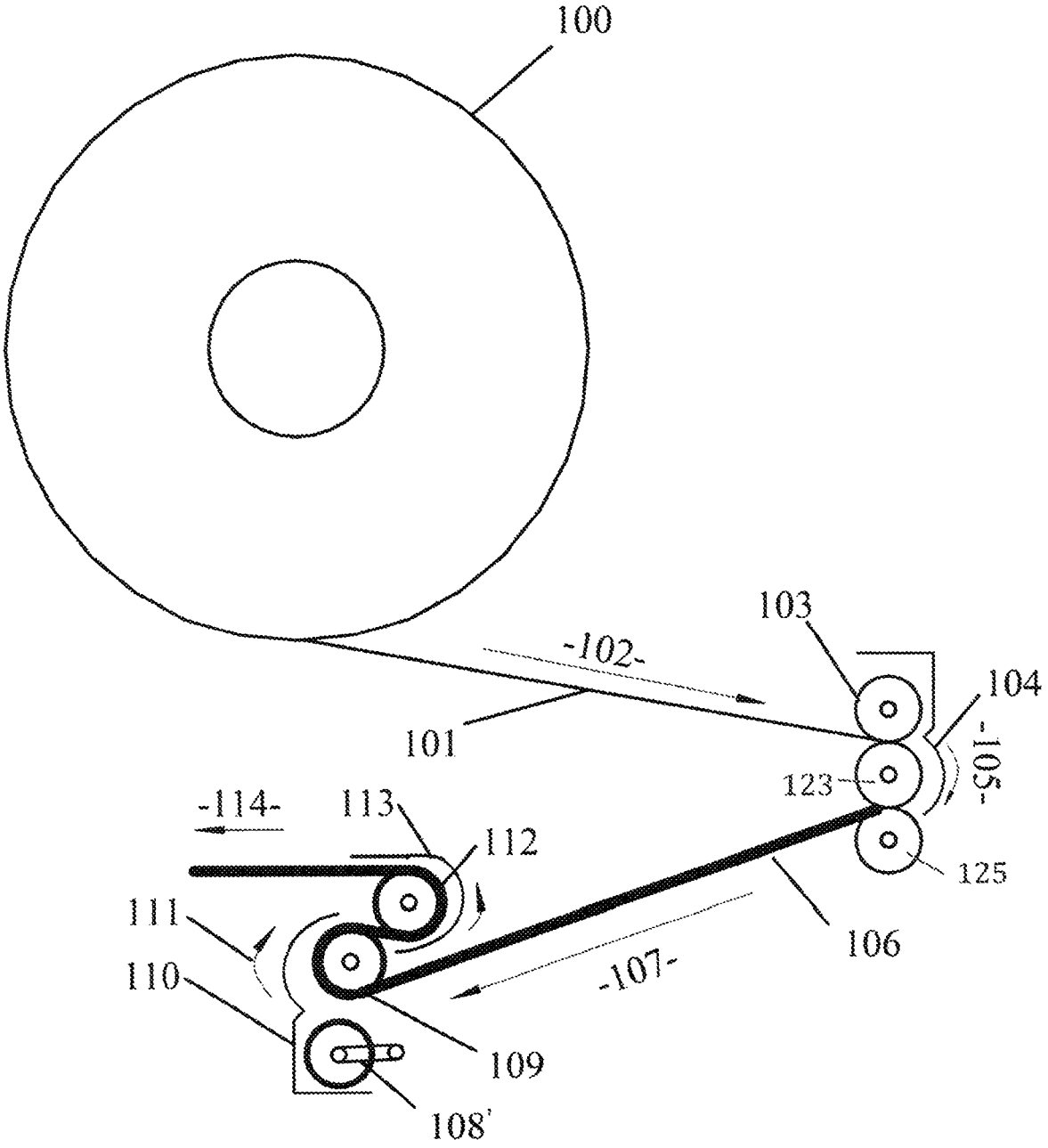
FIG. 2 is a side view of the embodiment shown in FIG. 1 in an operating configuration.

FIG. 1 is a side view of the slit paper system being loaded that starts with the paper roll 100 being unwound manually in a continuous sheet 101 and guided by paper guide 120 in the direction 102 to pressure rollers 103, and as shown in FIG. 2, rollers 123 and 125. Pressure rollers then pull the slit sheet and paper guide 104 directs it to the lower roller portion of the pressure rollers in the direction of arrow 105. The slit paper 102 continues along paper guide 122 unexpanded but, will immediately start expanding when it passes through the expansion rollers (i.e., hook rollers) 109 and the loading hook roller 108. When this expansion occurs, the slit paper becomes thicker and becomes an expanded slit sheet 106 (i.e., is expanded to an expanded state having an increased thickness). As the expanded paper passes through hook roller 109 and loading hook roller 108 it is directed with paper guide 110 around hook roller 109 to hook roller 112 in the direction of arrow 111. Paper guide 113 guides the paper around roller 112 in the direction of arrow 116 and exits in the direction of arrow 114.

FIG. 2 is a side view of the hook rollers where hook loading roller 108 has been rotated downward in the direction of arrow 200 to eliminate the crushing effect.

Figure 3:
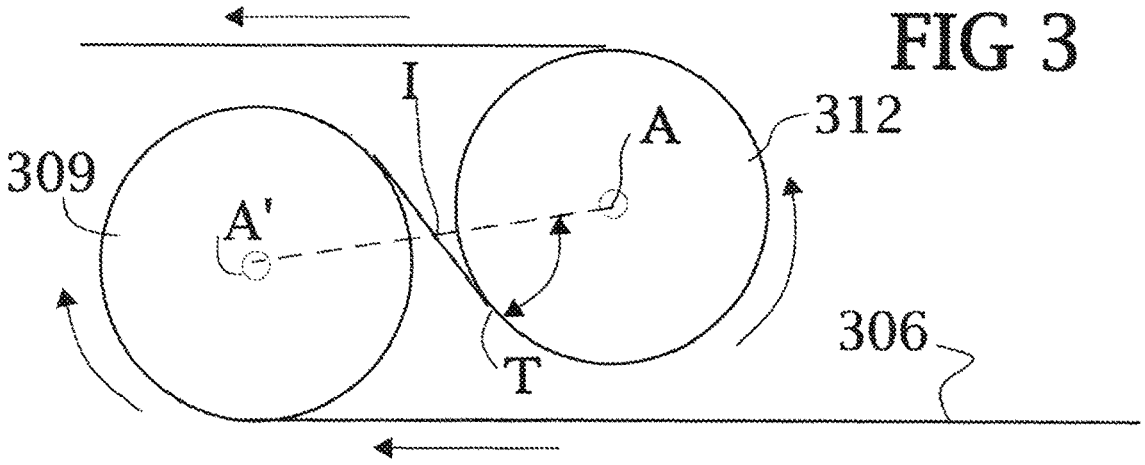
FIG. 3 is a side view of "S" pattern slit paper flow around a pair of expansion rollers (e.g., hook rollers) in another embodiment.
Figure 4:
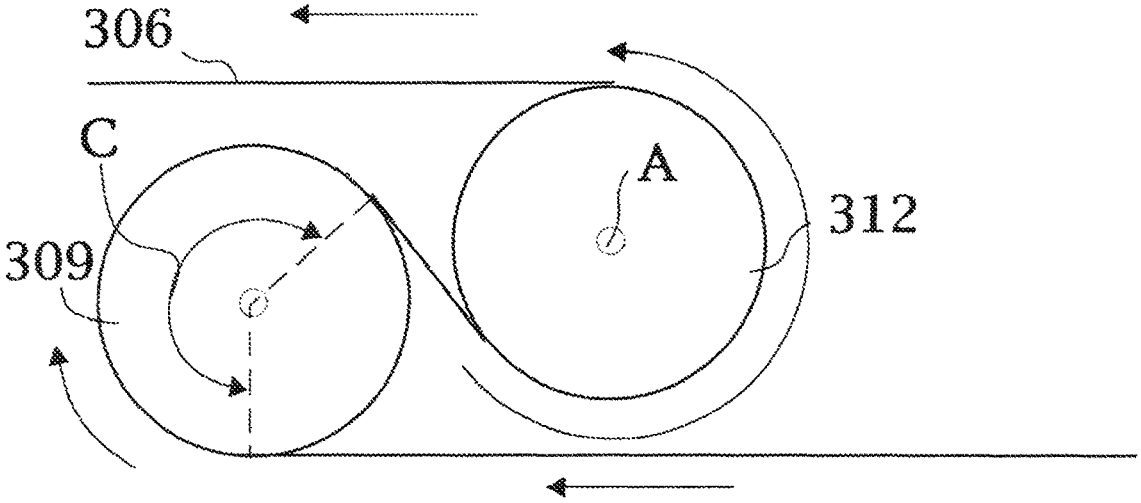
FIG. 4 is a side view of "S" pattern slit paper flow around the pair of expansion rollers (e.g., hook rollers) of FIG. 3.

In FIGS. 3 and 4, the S shaped path that the slit paper takes between the rollers 309 and 312 can be described from a variety of perspectives. Looking from the perspective of angles formed by the axis of rollers 309 and 312, the intersection of the path of the slit paper with a line between the axis of each roller, and the tangent point at which the paper leaves a roller, is an acute angle. The relative positions of the two rollers and their proximity has a bearing on the acute angle that is formed. For example, the closer the proximity of the two rollers, the greater the acute angle.

Looking further to FIG. 3, the line between the axis A of roller 312 and the axis A' of roller 309 intersects with the slit paper at point I. The angle (<) A-I-T, where T is the tangent point of contact between the paper and the circumference of the roller 312 is an acute angle. In the expansion system of FIG. 3, the slit paper tangentially contacts hook roller 309, interacts with the hook components of the hook roller 309, and is delivered tangentially to the point of tangent contact with hook roller 312. It should be noted that while contact with a roller is at a tangent point, the hooks of a hook roller can cause the slit paper to separate from the hooks at a point slightly beyond the point of tangency, depending upon the speed at which the paper is traveling and the tension on the slit paper. Accordingly, the term "tangent point" as employed herein, is inclusive of the slight deviation from a tangent.

With reference to FIG. 4, the slit paper 306 wraps around each of the rollers 309 and 312 following an S shaped path as indicated by the arrows shown in FIG. 3 and FIG. 4. The tendency of the expanded slit sheet to slip backward towards the rubber pinch rollers 103 as shown in FIG. 2, which can cause the sheet to revert to becoming partly or fully unstretched and, thus, unexpanded, is in an inverse ratio to the degree of contact between the slit paper 306 and the hook surface of the rollers 309 and 312. Thus, where the contact region between the slit paper 306 and the hooks of the rollers is up to about ⅔ (around 235°) backward slip prevention is optimized. It is noted that a contact arc that is preferably less than 270 degrees is required for ease of machinery design and construction, and, accordingly, a lesser arcuate contact region is provided (e.g., lesser than 270 degrees).

The contact region advantageously is greater than ¼ of the circumference (i.e., 90°), and preferably greater than ½ of the circumference (i.e., 180°), and, most preferably, up to about 250°, which produces contact of the paper with about 70% of the hook surface of the rollers.

Furthermore, contact of the slit sheet with the hooks of each roller is preferably advantageously in the range from 90° to less than 270°. More preferably, contact of the slit sheet with the hooks of each roller is in the range from 180° to 235° which produces contact of the paper in the range from about 50% to 65% of the hook surface of the rollers. As shown in in the embodiment of FIG. 4, the arc C shows that the slit paper contacts more than 50% of the circumference of the hook roller 309. Notably, although the degree of contact of the paper with the hook surfaces of the rollers 309 and 312 can be different from one another, advantageously, the degree of contact can be optimized for each roller in the preferred embodiments.

Figure 5:
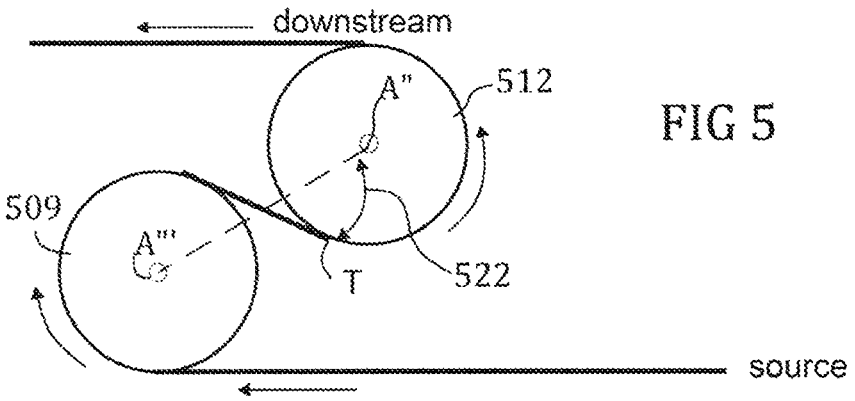
FIG. 5 is a side view of further "S" pattern slit paper flow around a pair of expansion rollers (e.g., hook rollers) in another embodiment.
Figure 6:
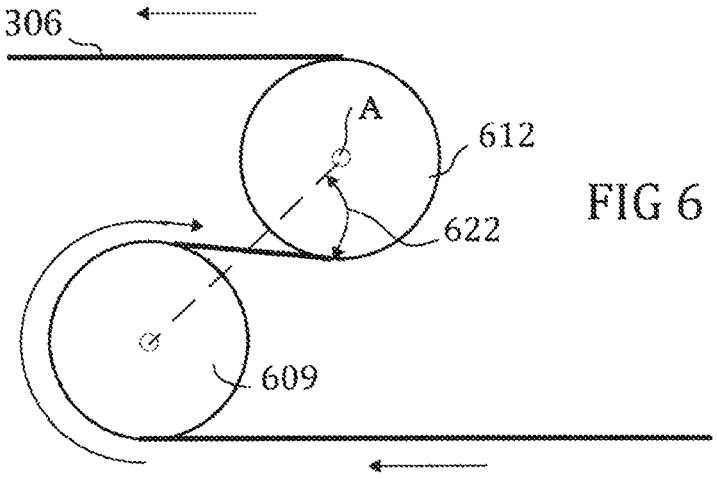
FIG. 6 is a side view of still another "S" pattern slit paper flow around a pair of expansion rollers (e.g., hook rollers) in another embodiment.
Figure 7:
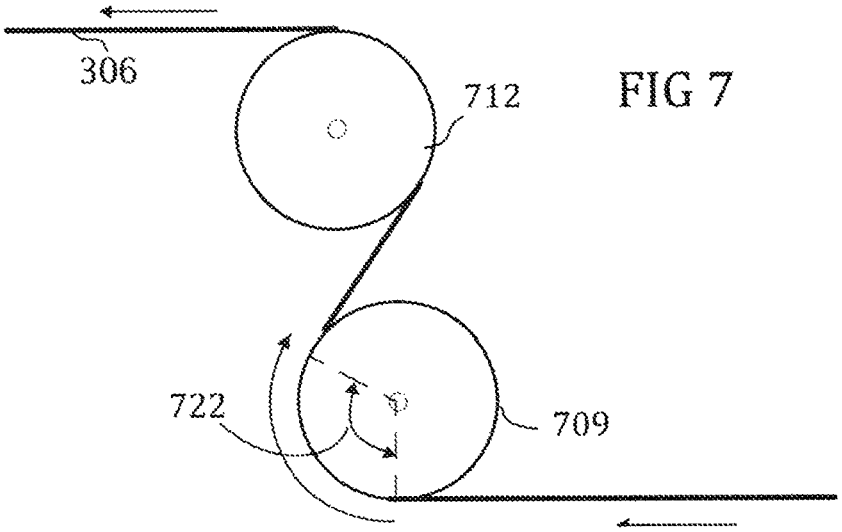
FIG. 7 is a side view of an alternate "S" pattern slit paper flow around a pair of expansion rollers (e.g., hook rollers) in another embodiment.

FIGS. 5, 6, and 7 show illustrative changes of degree of contact between the slit paper and the roller based upon the relative positions of the two hook rollers 509 and 512. As shown in FIG. 5, a line between axis A" and axis A'" intersects with the expanded paper flowing from roller 509 to roller 512 to form an acute angle 522.

In FIG. 6, the acute angle 622 is narrower than the acute angle 522 of FIG. 5. As shown in FIGS. 5 and 6, as the relative positions of rollers 509 and 512 are changed to the relative positions of rollers 609 and 612, the degree of arcuate contact between the slit paper 306 and the rollers decreases.

FIG. 7 shows an alternate "S" path flow pattern in which the slit paper 306 contacts the roller 709 along an arc 722 that is smaller than the arcuate contact regions illustrated in FIG. 5 and FIG. 6. As shown in FIGS. 6 and 7, as the relative positions of rollers 609 and 612 are changed to the relative positions of rollers 709 and 712, the degree of arcuate contact between the slit paper 306 and the rollers become further decreased.

Figure 8:
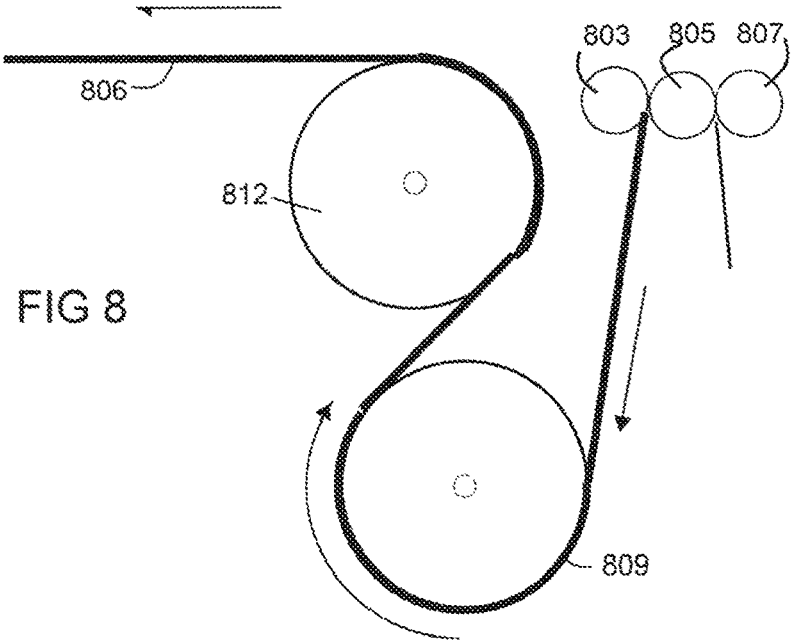
FIG. 8 is a side view of "S" pattern slit paper flow in another embodiment.

FIG. 8 shows a further embodiment in which the degree of arcuate contact between the slit paper 806 and the rollers 809 and 812 based upon the tangent points of contact of the slit paper with each of the two hook rollers 809 and 812 is adjusted. As with embodiments discussed above, to impart expansion of the expandable slit sheet, the nip rollers 803, 805, and 807 rotate at a slower speed than the hook rollers 809 and 812, thus causing the slit paper 806 to expand and form three dimensional hexagonal cells.

Figure 9:
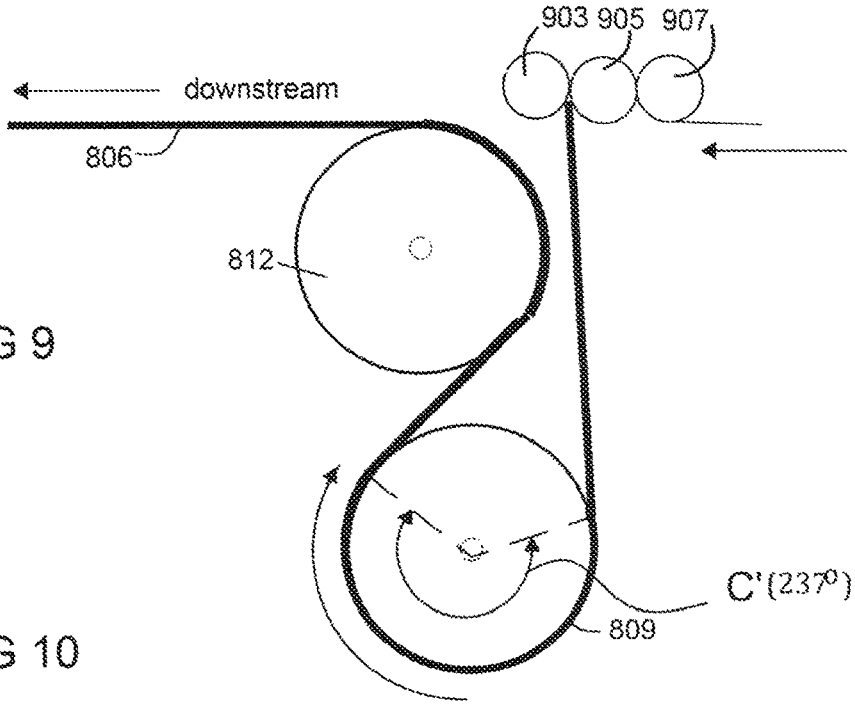
FIG. 9 is a side view of another "S" pattern slit paper flow in another embodiment.

FIG. 9 shows a further embodiment in which the degree of arcuate contact between the slit paper 806 and the rollers 809 and 812 based upon the tangent points of contact of the slit paper with each of the two hook rollers 809 and 812 is even further adjusted. As with embodiments discussed above, the nip rollers 903, 905, and 907 rotate at a slower speed than the hook rollers 809 and 812, thus causing the slit paper 806 to expand and form three dimensional hexagonal cells. A shown in FIG. 9, the position of nip rollers 903, 905, and 907 relative to the hook roller 809 produces a contact arc C' that is greater than the contact arc between slit paper 806 and hook roller 809.

Figure 10:
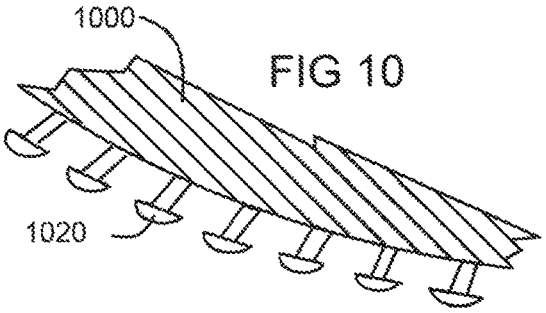
FIG. 10 is a fragmentary view of an illustrative expansion roller (e.g., hook roller) having a plurality of hooks with mushroom shaped hook ends.

For illustrative purposes, FIG. 10 shows a partial view of a portion of an expansion roller (e.g., hook roller) 1000 according to some illustrative and non-limiting embodiments. In this illustrative embodiment, the hook roller 1000 includes a multitude of hooks 1020 distributed around the peripheral surface of the roller. Towards that end, in the preferred embodiments, it should be appreciated that the hook rollers should have a length sufficient to extend across entirely or substantially entirely the entire width of the expandable slit sheet paper passing thereby, with a corresponding entire periphery or substantially the entire periphery of the hook roller having a multitude of hooks extending therefrom in order to be engageable with corresponding slits within the expandable slit sheet paper around the entire periphery of the hook roller, and across the entire width of the expandable slit sheet paper. In the illustrative example shown in FIG. 10, the hooks 1020 each include a base portion that extends downward to a cylindrical core of the hook roller 100 and a widened catching head portion. In some embodiments, the hooks 1020 can be randomly distributed on the entire periphery of the hook roller, while in other embodiments, the hooks 1020 can be arranged in an array of hooks 1020 extending around the entire periphery of the hook roller. In some embodiments, the hooks 1020 are sized such that a plurality of hooks 1020 are capable of engaging with a respective slit of the expandable slit sheet paper. Similarly, in some preferred embodiments, the hooks 1020 are distributed closely adjacent one another such that a plurality of hooks 1020 are capable of engaging with a respective slit of the expandable slit sheet paper. Although FIG. 10 shows an illustrative design of the hook rollers and hooks according to some illustrative embodiments, it should be appreciated that various other embodiments can include other hook configurations as discussed herein. Moreover, in the preferred embodiments, the hooks 1020 are flexible, such that the hooks 1020 are capable of flexibly entering the slits of the expandable slit sheet paper and/or flexible exiting the slits of the expandable slit sheet paper. In some preferred embodiments, the base portions of the hooks 1020 (which can be, e.g., substantially cylindrically shaped or otherwise shaped shaft portions) can be flexible such as to allow the hooks 1020 to flexibly be received and/or removed from the respective slits of the expandable slit sheet paper.

Figure 12:
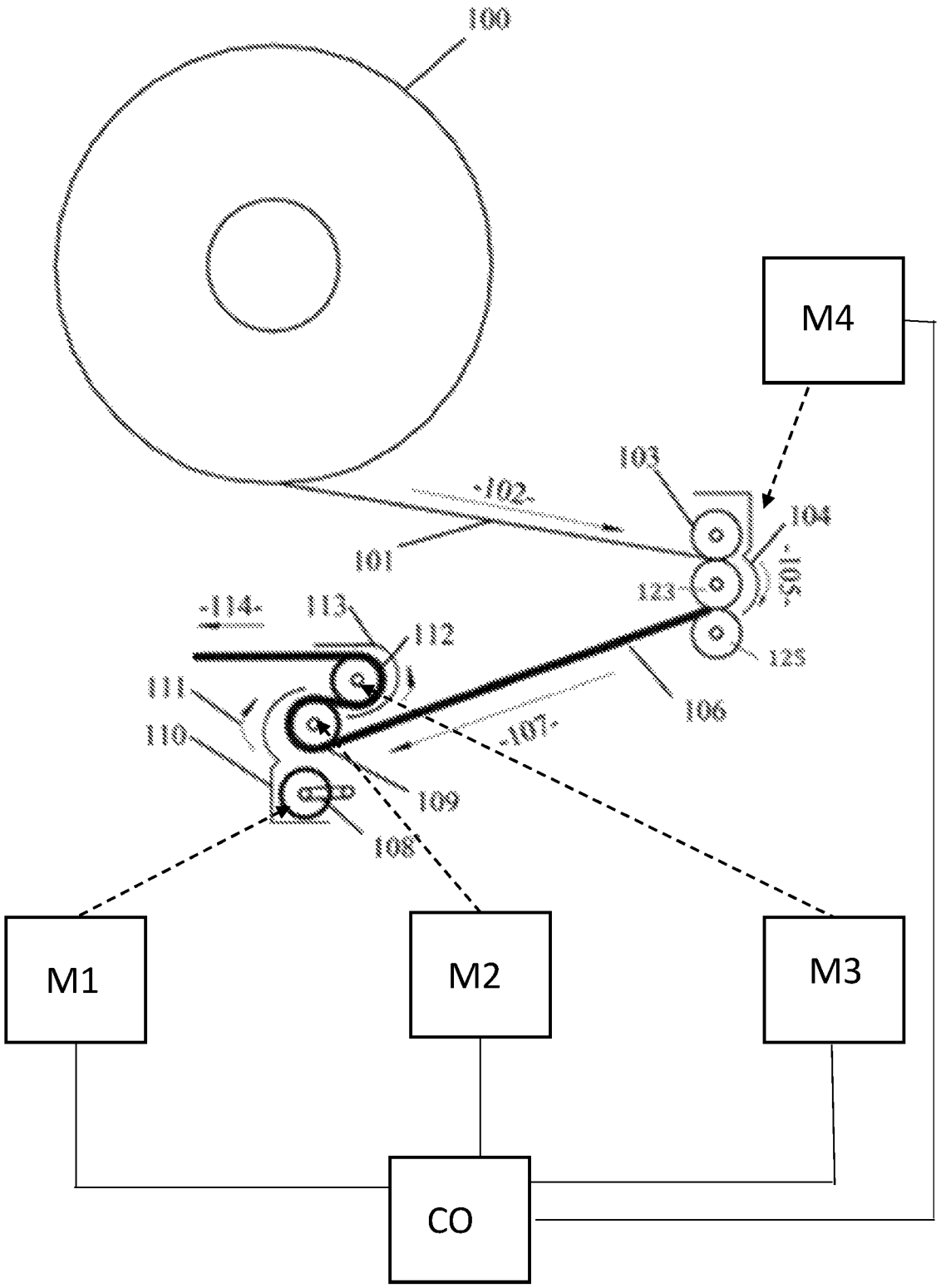
FIG. 12 is a side view similar to that shown in FIG. 1 with illustrative control elements added according to some illustrative embodiments.

FIG. 12 is similar to FIG. 1, but includes illustrative control elements according to some illustrative and non-limiting embodiments of the invention. Towards this end, FIG. 12 illustrates that in some embodiments of the invention one or more motor or drive mechanism M (four motors or drive mechanisms M1, M2, M3 and M4 being shown in the illustrative and non-limiting example) is/are employed for imparting rotation to the respective rollers. By way of example, in this illustrative example shown in FIG. 12, a motor or drive M1 is connected to rotationally drive the roller 108, a motor or drive M2 is connected to rotationally drive the roller 109, and a motor or drive M3 is connected to rotationally drive the roller 112. Moreover, as also shown in FIG. 12 a motor or drive M4 is connected to rotationally drive the rollers 102, 123, and/or 125.

As also depicted in FIG. 12, in some illustrative preferred embodiments, a controller CO is also provided that provides control of the motor(s) or drive(s) (e.g., motors or drives M1 to M4 in the illustrative example) in order to control the operation of the system and methods of the preferred embodiments. In some illustrative embodiments, the controller CO can include at least one computer that is programmed to control the operation of the motor(s). By way of example, the at least one computer can include a keyboard and display for user entry of inputs (e.g., to control timing, rotational speeds, etc.), along with memory and digital data store, and appropriate programming for carrying out functions of the preferred embodiments. Additionally, the at least one computer can also include input and output mechanisms for receiving and sending signals, such as, e.g., to monitor operation of the motor(s), and to send control signals to control the speed and timing of the motors. Moreover, the controller CO can also be adapted to control operation of other elements, such as, e.g., by way of example, to control the reciprocation movement of the roller 108 between the positions shown in FIG. 1 and FIG. 2. Towards that end, in some illustrative examples, this reciprocation can be imparted by mounting the reciprocated roller 108 on a reciprocatable arm that can be pivotally moved via a solenoid member that is controlled by way of the controller CO.

It should be appreciated that FIG. 12 shows an illustrative and non-limiting example and that the systems and methods of the present invention can be implemented with a variety of other structures. By way of example, although a plurality of illustrative motors or drives M1-M4 are depicted, it should be appreciated that in various embodiments, a single motor or drive can be employed to rotate a plurality of rollers, including rollers that are rotated at different rates. By way of example, various conveyor belts, pulleys, gears and the like can be employed in order to drive a plurality of rollers via a single motor or drive, including independent driving and driving at different rates of rotation.

Thus, while the preferred embodiments provide a structure that enables automated or machine controlled expansion of expandable slit sheet material, it should be appreciated that such automated or machine controlled expansion of expandable slit sheet material can employ a wide variety of drive mechanisms and mechanisms to control rotation and movement of rollers, etc., in accordance with the preferred embodiments of the invention.

OTHER EMBODIMENTS

Although some preferred embodiments employ two expansion rollers that form an S-curve as shown, e.g., in the embodiments of FIGS. 1-9, in some other embodiments, additional expansion rollers (e.g., hook rollers) can be employed. For example, in some other embodiments, three (3) expansion rollers can be employed, or, alternatively, four (4) expansion rollers can be employed, or, even more in some embodiments. Regardless of the number of expansion rollers, in the preferred embodiments, all of the adjacent expansion rollers are separated in a manner to avoid compression or crushing of the expanded slit sheet paper as discussed above. Moreover, regardless of the number of expansion rollers, in the preferred embodiments, the expansion rollers create the above-described S-curve between two adjacent ones of the expansion rollers. For example, in some preferred embodiments, the first and second expansion rollers (i.e., the most upstream expansion rollers) are preferably arranged and configured as shown and described in relation to embodiments discussed above.

Figure 13:
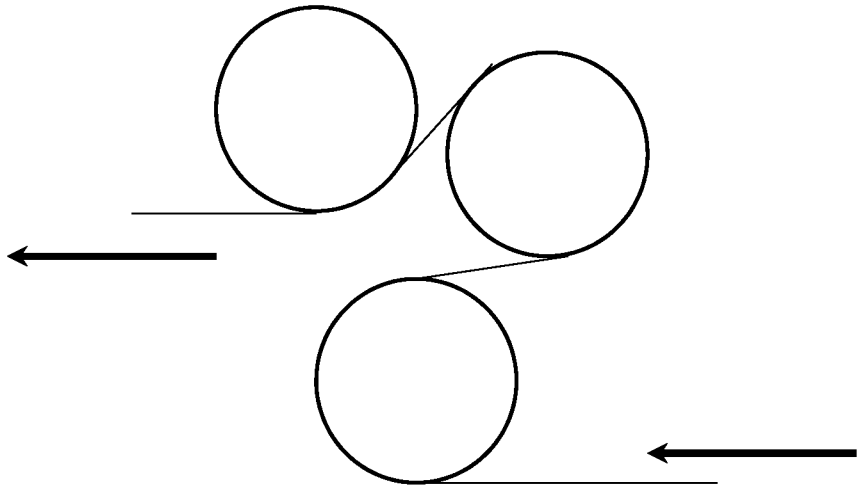
FIG. 13 and FIG. 14 are illustrative side views of other illustrative embodiments of the present invention employing three and four expansion rollers, respectively, according to some other illustrative embodiments.
Figure 14:
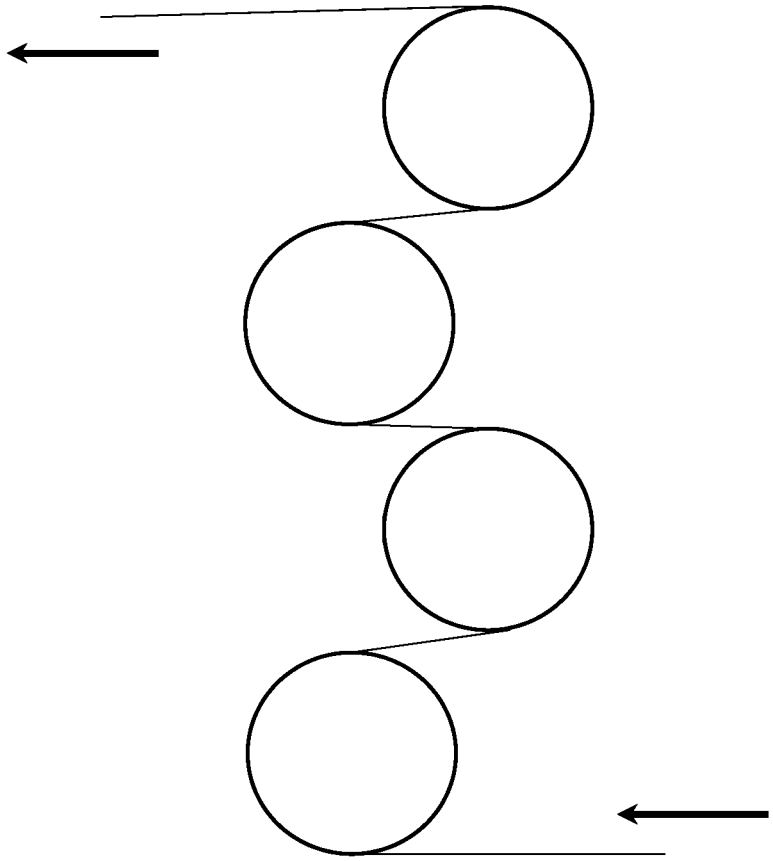

For illustrative purposes, FIG. 13 shows an illustrative arrangement employing three (3) expansion rollers according to some illustrative embodiments, and FIG. 14 shows another illustrative arrangement employing four (4) expansion rollers according to some other illustrative embodiments.

In some of the more preferred embodiments, the expansion rollers preferably each include hooks distributed on their peripheries. For example, in the embodiments shown in FIGS. 1 and 2, the rollers 109 and 112 preferably both include hooks distributed on their peripheries. In addition, in the embodiments shown in FIGS. 3 and 4, the rollers 309 and 312 preferably both include hooks distributed on their peripheries. In addition, in the embodiment shown in FIG. 5, the rollers 509 and 512 preferably both include hooks distributed on their peripheries. In addition, in the embodiment shown in FIG. 6, the rollers 609 and 612 preferably both include hooks distributed on their peripheries. In addition, in the embodiment shown in FIG. 7, the rollers 709 and 712 preferably both include hooks distributed on their peripheries. In addition, in the embodiments shown in FIGS. 8 and 9, the rollers 809 and 812 preferably both include hooks distributed on their peripheries.

However, although the expansion rollers preferably each include hooks distributed on their peripheries, in some embodiments one or more of the expansion rollers can include hooks distributed around their peripheries (i.e., as long as at least one of the expansion rollers includes such hooks distributed on its periphery), while other(s) of the expansion rollers can omit such hooks. For example, in some illustrative embodiments, rather than employing such hooks, such other(s) of the expansion rollers can include a rubber, foam or other higher friction surface without employing such hooks.

However, in some of the more preferred embodiments, if any of the expansion rollers do not include hooks distributed on their peripheries, at least a first roller (i.e., a most upstream of the expansion rollers) would include such hooks. Notably, this can be particularly important in the context of a device in which the expanded sheet that is fed downstream from the expansion rollers is first cut, such as, e.g., with a die cutter. Among other things, this is helpful for ensuring that the expandable slit sheet material is expanded more evenly. In the event that such hooks are distributed on the second expansion roller downstream but not on the first expansion roller downstream, this could potentially lead to chaotic opening of the cells that can cause a rippling effect across the web of expanded slit sheet paper.

In embodiments in which a system or method of the present invention is employed for wrapping of a product (e.g., in which the expanded slit sheet material is fed downstream for wrapping of a product), in order to most appropriately expand the material preferably all of the expansion rollers include hooks distributed on their periphery. Among other things, in this context, it is important to avoid slippage of the expanded slit sheet material. In such embodiments, it is also helpful to include three expansion rollers (rather than two in many of the illustrated embodiments shown herein) to help further reduce potential for slippage. In addition, in this context, it is also helpful to minimize the distance between the expansion rollers to further minimize potential slippage. If there is slippage, then the slit sheet material slips backwards (i.e., upstream) away from the stage downstream of the expansion rollers (such as, e.g., a wrapping device or a packer {e.g., a human packer} that is situated downstream of the expansion rollers) and makes it difficult to wrap or pack the next item as, e.g., a packer reaches in for the material that has slipped backward.

On the other hand, in the case of an automated downstream system, such as, e.g., in the case of an automated envelope manufacturing system, the expanded slit sheet material leaving downstream from the expansion rollers can be handled in a manner that is not readily slipped. For example, in some embodiments, the expanded slit sheet material is fed downstream to a gluing device that continuously pulls the expanded material. Accordingly, in that context, there is a reduced risk of slippage. Accordingly, in the context of an automated downstream system, such as, e.g., in the context of an automated envelope manufacturing system, then some of the expansion rollers can omit hooks around their peripheries without significant risk of slippage issues described above.

In the context of manufacturing of an envelope, in some examples, a single expansion roller can include hooks distributed around the periphery in a manner to sufficiently apply a uniform stretch—i.e., because the expanded slit sheet paper is held by downstream equipment during the manufacturing of the envelope process. In some preferred embodiments, when manufacturing an envelope, the hook material on the expansion rollers helps maintain the width of the expanded slit material, which is helpful for downstream fabrication of the envelope in some embodiments. For example, in some embodiments, in a downstream step from the expansion rollers, the expanded slit sheet material is glued along the sides of the expanded slit sheet material, and the hooks help to ensure that the expanded slit sheet web is not varying in width an extent that could, thus, lead to incomplete gluing of the sides.

In some embodiments, the expandable slit sheet paper is initially in an unslit state. For example, the unslit paper can be fed initially to a first roller that is essentially a die cutter that cuts the slits into the paper. In some embodiments, the die cutter has foam wrapped around it, so that the slit paper is held firmly and evenly upon exiting the die cutter. After being fed from the die cutter, in the preferred embodiments, the first expansion roller is preferably wrapped or surrounded by a material having an distribution of hooks (e.g., which roller operates at a faster rate to stretch and expand the expandable slit sheet paper).

Accordingly, as discussed above, in many preferred embodiments of the invention, all of the expansion rollers (e.g., hook rollers), such as, e.g., all of the expansion rollers (e.g., hook rollers) shown in FIGS. 1-9 and even FIGS. 13-14 can be formed as hook rollers with hooks distributed around peripheries thereof in some preferred implementations of each of the embodiments. However, in some other implementations of those embodiments shown in FIGS. 1-9 and FIGS. 13-14, one or more of the expansion rollers can be implemented without hooks distributed there-around, as discussed above.

Figure 15:
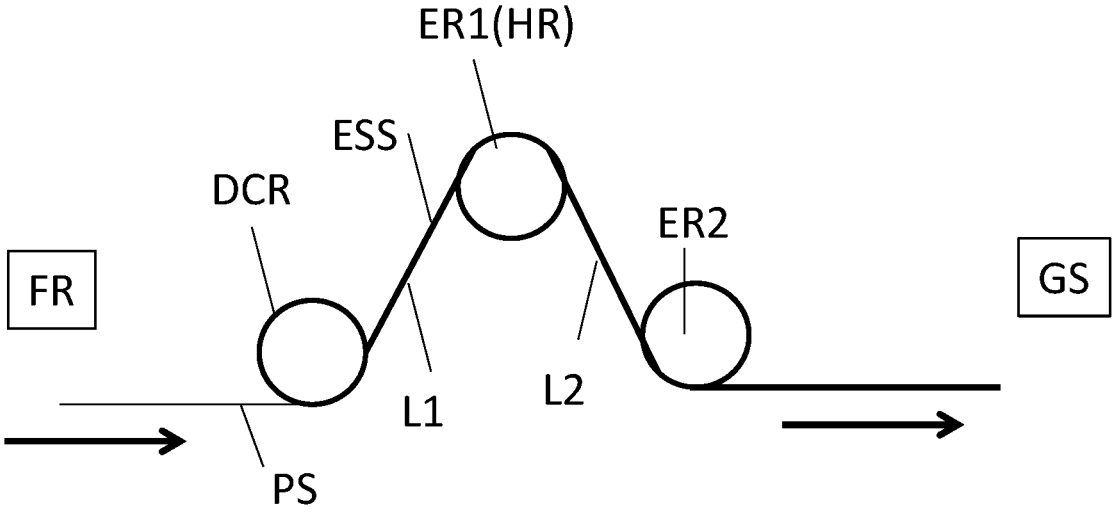
FIG. 15 shows the expandable slit sheet being conveyed further downstream to a first expansion conveyor according to some embodiments.
Figure 16:
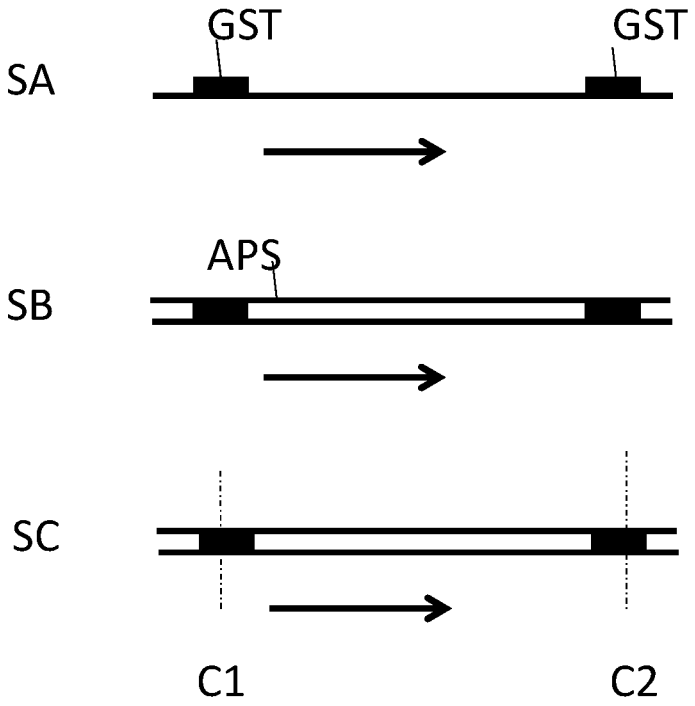
FIG. 16 illustrates a plurality of sub-steps of a processing step according to some embodiments.

FIGS. 15 and 16 show an illustrative embodiment of the invention in the context of an envelope manufacturing process. In this illustrative embodiment, a paper sheet PS is feed from an upstream process step FR. In some illustrative examples, the upstream process step FR includes delivery of the paper sheet PS from a feed roll, wherein the feed roll includes a paper web wound around a core, which is feed in a downstream direction. In some embodiments, the paper web has a width of about 8" to 24", or, in some embodiments, about 12" to 18", or, in some embodiments about 14" to 16".

In the illustrated embodiment, the paper sheet PS web is fed to a die cutting roller DCR that is configured to cut a slit pattern in the paper sheet PS, such that the paper sheet PS is formed into an expandable slit sheet ESS. Although not shown, in some illustrative embodiments, the die cutting roller can include another cooperative roller that together cut the paper sheet PS (such as, e.g., employing peripheral blades on one of the cooperative roller or the die cutting roller that cut slits as the paper sheet is conveyed past the die cutting roller. This structure can be similar to that of the background art for formation of slit patterns of expandable slit sheet material. In the preferred embodiment, as discussed above, the die cutting roller DCR rotates at a rate that conveys the paper sheet PS at a first reduced speed.

As shown in FIG. 15, the expandable slit sheet ESS is conveyed further downstream to a first expansion conveyor ER1. As also described with respect to embodiments discussed above, in the preferred embodiments, the first expansion conveyor ER1 preferably rotates at a rate that conveys the expandable slit sheet ESS at a rate that is faster than the reduced speed such as to fully expand the expandable slit sheet ESS in the spanning distance L1 of the expandable slit sheet ESS between the die cutting roller DCR and the first expansion roller ER1. In some illustrative embodiments, the distance L1 is sufficient to enable the expandable slit sheet ESS to fully expand; for example, in some embodiments, the distance is more than about 4", while in some other embodiments, the distance is more than about 6", while in some other embodiments, the distance is more than about 8", while in some other embodiments, the distance is more than about 10", while in some other embodiments, the distance is more than about 12".

As shown in FIG. 15, in the preferred embodiments, the first expansion roller E1 is formed as a hook roller HR having a multitude of hooks around the periphery thereof, as discussed herein above with respect to the various embodiments discussed above. In this embodiment shown in FIG. 15, the expandable slit sheet ESS is conveyed around the hook roller HR (i.e., ER1) and then is directed towards a second expansion roller ER2. Although many of the preferred embodiments involve providing of a cooperating pair of expansion rollers in somewhat close proximity to one another, in this illustrative embodiment shown in FIGS. 15 and 16, the second expansion roller ER2 is further displaced downstream from the first expansion roller ER1. For example, in some embodiments, the spanning distance L2 of the expanded expandable slit sheet ESS can be the same as any of the values listed above for the spanning distance L1 (note: although in some embodiments, the distances L1 and L2 can be approximately equal—such as, e.g., shown in the illustration of FIG. 15, the values of L1 and L2 can be any appropriate value described herein and do not have to be similar). Notably, in the preferred embodiments, the distance L2 is not critical, but, rather, a more important factor in relation to the spanning distance L2 is the angle of departure of the expandable slit sheet ESS from the first expansion roll ER1 (HR). Notably, an advantageous factor with respect to the embodiment shown in FIG. 15 is the degree of the arc of contact between the expandable slit sheet ESS and the hook roller HR (i.e., ER1).

Notably, in the preferred embodiments, the degree of the arc of contact between the expandable slit sheet ESS and the hook roller HR is preferably an arc of at least 40 degrees. In some other embodiments, the arc of contact is at least 60 degrees. In some other embodiments, the arc of contact is at least 80 degrees. In some other embodiments, the arc of contact is at least 100 degrees. In some other embodiments, the arc of contact is at least 120 degrees. In some other embodiments, the arc of contact is at least 140 degrees. In some other embodiments, the arc of contact is at least 180 degrees, or even more in other embodiments (similar to that described above). However, in some preferred embodiments, the arc of contact is between about 60 to 120 degrees.

In the embodiment shown in FIG. 15, the second expansion roller ER2 can be a roller that does not have hooks distributed around a periphery thereof. Of course, in some embodiments, the roller ER2 can be a similar hook roller with hooks there-around. But, in some embodiments, it is not necessary. For example, in some embodiments, the expanded slit sheet ESS is feed further downstream to a downstream process step GS. In some embodiments, the downstream process step GS includes a gluing step. In some preferred embodiments, this further processing step involves further conveyor(s) and/or other mechanism that grasp the expanded slit sheet ESS, whereby the need for hooks on the second expansion roller ER2 are not necessary in some embodiments.

With reference to FIG. 16, in some embodiments, the processing step GS can include a plurality of sub-steps SA, SB and SC. In the sub-step SA, transverse glue strips GST are applied to the expanded slit sheet ESS as the sheet moves in a direction of the arrow show (i.e., in a machine direction). Then, as shown in sub-step SB, another paper sheet APS is aligned along the expanded slit sheet ESS and glued thereto. Then, as shown in sub-step SC, the combined sheets can be cut along the dashed lines extending transversely across the web through the glue strip locations at C1 and C2, such as to separate the combined sheets into individual components (e.g., envelope parts). It should be appreciated that these steps are not the entire steps of fabrication of an envelope, but rather steps within the process of fabrication of an envelope, including fabrication of a portion of a wall of the envelope. In some embodiments, further process steps can be carried out, such as, e.g., steps as described in U.S. application Ser. No. 16/531,017, filed Aug. 3, 2019, entitled Protective Products, Such as Envelopes, Having a Unique Combination of Interior Padding of Expanded Slit Sheet Paper and Exterior Lining of Embossed Paper, of the present inventor, such as, e.g., to create envelopes of the type disclosed in the Ser. No. 16/531,017 application, the entire disclosure of which is incorporated herein by reference as though recited herein in full. According to other embodiments, aspects or process steps for manufacturing envelopes as set forth in one or more of the following U.S. Patents and Patent Publications can be implemented, the entire disclosures of which prior patents are all incorporated herein by reference as though recited herein in full: 1) U.S. Patent No. 851,934 entitled Manufacture of Envelopes, 2) U.S. Pat. No. 4,205,504 entitled Method and Device for Making Envelopes from a Continuous Web and Including Stuffing and Sealing of those Envelopes, 3) U.S. Pat. No. 3,069,982 entitled Manufacture of Quick-Opening Envelopes or Bags, 4) U.S. Pat. No. 4,091,596 entitled Method of and Apparatus for Manufacturing Envelopes, 5) U.S. Patent Publication No. 2002/001452 entitled Method for Manufacturing Mailing-Ready Printed Products and Envelopes for Use with Such Method, and 6) U.S. Patent Publication No. 2017/0107017 entitled Expandable Web Material for Envelope Construction.

BROAD SCOPE OF THE INVENTION

While the invention has been described in terms of several preferred embodiments, it should be understood that there are many alterations, permutations, and equivalents that fall within the scope of this invention. It should also be noted that there are alternative ways of implementing both the process and apparatus of the present invention. For example, steps do not necessarily need to occur in the orders shown in the accompanying figures and may be rearranged as appropriate. It is therefore intended that the appended claim includes all such alterations, permutations, and equivalents as fall within the true spirit and scope of the present invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of this disclosure (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., such as, preferred, preferably) provided herein, is intended merely to further illustrate the content of the disclosure and does not pose a limitation on the scope of the claims. No language in the specification should be construed as indicating any non-claimed element as essential to the practice of the present disclosure.

Multiple embodiments are described herein, including the best mode known to the inventors for practicing the claimed invention. Of these, variations of the disclosed embodiments will become apparent to those of ordinary skill in the art upon reading the foregoing disclosure. The inventors expect skilled artisans to employ such variations as appropriate (e.g., altering or combining features or embodiments), and the inventors intend for the invention to be practiced otherwise than as specifically described herein.

Accordingly, this invention includes all modifications and equivalents of the subject matter recited in the claims appended hereto as permitted by applicable law. Moreover, any combination of the above described elements in all possible variations thereof is encompassed by the invention unless otherwise indicated herein or otherwise clearly contradicted by context.

The use of individual numerical values is stated as approximations as though the values were preceded by the word "about", "substantially", or "approximately." Similarly, the numerical values in the various ranges specified in this application, unless expressly indicated otherwise, are stated as approximations as though the minimum and maximum values within the stated ranges were both preceded by the word "about", "substantially", or "approximately." In this manner, variations above and below the stated ranges can be used to achieve substantially the same results as values within the ranges. As used herein, the terms "about", "substantially", and "approximately" when referring to a numerical value shall have their plain and ordinary meanings to a person of ordinary skill in the art to which the disclosed subject matter is most closely related or the art relevant to the range or element at issue. The amount of broadening from the strict numerical boundary depends upon many factors. For example, some of the factors which may be considered include the criticality of the element and/or the effect a given amount of variation will have on the performance of the claimed subject matter, as well as other considerations known to those of skill in the art. As used herein, the use of differing amounts of significant digits for different numerical values is not meant to limit how the use of the words "about", "substantially", or "approximately" will serve to broaden a particular numerical value or range. Thus, as a general matter, "about", "substantially", or "approximately" broaden the numerical value. Also, the disclosure of ranges is intended as a continuous range including every value between the minimum and maximum values plus the broadening of the range afforded by the use of the term "about", "substantially", or "approximately". Thus, recitation of ranges of values herein are merely intended to serve as a shorthand method of referring individually to each separate value falling within the range, unless otherwise indicated herein, and each separate value is incorporated into the specification as if it were individually recited herein. To the extent that determining a given amount of variation of some the factors such as the criticality of the slit patterns, paper width differential pre- and post-expansion, paper weights and type, as well as other considerations known to those of skill in the art to which the disclosed subject matter is most closely related or the art relevant to the range or element at issue will have on the performance of the claimed subject matter, is not considered to be within the ability of one of ordinary skill in the art, or is not explicitly stated in the claims, then the terms "about", "substantially", and "approximately" should be understood to mean the numerical value, plus or minus 15%.

It is to be understood that any ranges, ratios and ranges of ratios that can be formed by, or derived from, any of the data disclosed herein represent further embodiments of the present disclosure and are included as part of the disclosure as though they were explicitly set forth. This includes ranges that can be formed that do or do not include a finite upper and/or lower boundary. Accordingly, a person of ordinary skill in the art most closely related to a particular range, ratio or range of ratios will appreciate that such values are unambiguously derivable from the data presented herein.

GLOSSARY OF REFERENCE NUMERALS

10 Expandable slit sheet.
14 Slits.
14L Slit length.
16 Slits (staggered from 14).
16L Slit length.
20 Land portions.
26 Three-dimensional hexagonal cells.
36 Slit spacing.
38 Row spacing.
38*a* Leg portion.
38*b* Leg portion.
100 Slit Sheet Material wound into a paper roll.
101 Slit continuous sheet being pulled towards the first set of nip roller trio 103, 123, and 125.
102 Direction of travel of the slit sheet to pressure rollers 103, 123, and 125.
103 Top roller or pressure rollers of the nip roller trio, 103, 123, and 125.
104 Paper guide member that guides paper to bottom nip roller of nip trio.
105 Direction of travel unexpanded slit sheet direction.
106 Expanded slit sheet.
107 Expanded slit sheet direction.
108 Guiding Hook Nip Roller in the Operating position (FIG. 1).
108' Guiding Hook Nip Roller in the Non-Operating position (FIG. 2).
109 Bottom Hook roller.
110 Guide member for use when loading slit paper.
111 Direction of travel of expanded slit sheet.
112 Top Hook Roller.
113 Guide member for guiding slit paper around Top Hook Roller 112.

114 Expanded Slit Sheet direction of travel.
116 Direction of travel Of Slit Sheet around hook Roller 112.
120 Guide member for use when loading slit paper.
122 Guide member for expanded slit paper.
123 Middle roller of the nip roller trio, 103, 123, and 125.
125 Bottom roller of the nip roller trio, 103, 123, and 125.
306 Slit Sheet Material traveling from Hook Rollers.
309 First Hook Roller for expanding Slit Sheet Material.
312 Second Hook Roller for expanding Slit Sheet Material.
509 Bottom (upstream) Hook roller.
512 Upper (downstream) Hook roller.
522 Angle formed by line through Axis A" and A'", and intersection of slit paper path to tangent point T'.
609 First Hook Roller in the path of slit paper 306.
612 Second Hook Roller upstream of First Hook Roller 609.
622 Angle formed by line through Axis A of Hook Roller 612 and axis of Hook Roller 609 and intersection of slit paper path to tangent point with Hook Roller 612.
709 Upstream (first encountered) Hook Roll.
712 Downstream (second encountered) Hook Roller.
722 Representation of arc of contact between Hook Roller 709 and Slit Paper 306.
803 Downstream roller of the nip roller trio 803, 805, and 807.
806 Upper (downstream) Hook roller.
809 Bottom (upstream) Hook roller.
903 Downstream roller of the nip roller trio 903, 905, and 907.
1000 Alternate modification of hook roller.
1020 Hook ends of Tines.
A Axis of hook Roller 312.
A' Axis of Hook Roller 309.
A" Axis of Hook Roller 512.
A'" Axis of Hook Roller 509.
APS
C Representation of arc of contact between Hook Roller 309 and Slit Paper 306.
C' Representation of arc of contact between Hook Roller 809 and Slit Paper 806.
C1 $1^{st}$ cutting location.
C2 $2^{nd}$ cutting location
CO Controller.
DCR Die Cutting Roller.
ER1 First Expansion Roller.
ER2 Second Expansion Roller.
ESS Extendable Slit Sheet.
FR Upstream Process Step (e.g., Feeding Roller)
GS Downstream Process Step (e.g., Gluing step).
GST Glue strip.
I Intersection of slit paper with theoretical line between A and A'.
L1 $1^{st}$ spanning length.
L2 $2^{nd}$ spanning length.
M Motor/Drive.
PS Paper sheet.
SA First sub-step.
SB Second sub step.
SC Third sub step.
T Point of tangential contact between slit paper 806 and Hook Roller 312.
T' Point of tangential contact between slit paper and Hook Roller 512.

What is claimed is:

1. A system having an expander for expanding and feeding an expandable slit sheet material with reduced damage to the expandable slit sheet material, comprising:

a) at least one first roller for feeding the expandable slit sheet material, said at least one first roller being adapted to rotate to move said expandable slit sheet material downstream at a first reduced rate;

b) at least two expansion rollers located downstream from the at least one first roller which receive the expandable slit sheet material from the at least one first roller, said at least two expansion rollers being adapted to rotate to move said expandable slit sheet material further downstream at a second rate that is faster than said first reduced rate, such as to cause said expandable slit sheet material to expand due to the second rate being faster than said first reduced rate;

c) said at least two expansion rollers including two adjacent expansion rollers arranged to adjacent one another, at least one of said two adjacent expansion rollers including a plurality of hooks distributed around a periphery thereof which are configured to engage slits of the expandable slit sheet material;

d) said two adjacent expansion rollers being separated from one another by a distance greater than a thickness of said expandable slit sheet material in an expanded state, such that the said two adjacent expansion rollers do not concurrently press against opposite sides of the expanded slit sheet material at a same longitudinal position of the expanded slit sheet material so that said two adjacent expansion rollers avoid damaging the expanded slit sheet material;

wherein said two adjacent expansion rollers are arranged, wherein a portion of the path of the expanded slit sheet material passing around said two adjacent expansion rollers is S-shape, with the path curving in a first direction around a periphery of one of said two adjacent expansion rollers and then in a second direction that is away from said first direction around a periphery of the other of said two adjacent rollers;

wherein said two adjacent expansion rollers are arranged, wherein the path of the expanded slit sheet material passing around each of said two adjacent expansion rollers includes the expanded slit sheet material contacting each of said two adjacent expansion rollers around respective arcs of at least 40 degrees around each of said adjacent expansion rollers.

2. The system of claim 1, wherein said system is an envelope manufacturing system.

3. The system of claim 2, wherein said system is configured to manufacture an envelope having the expanded slit sheet material in a peripheral wall of the envelope for protection of an item within the envelope.

4. A method of using the system of claim 3, comprising: manufacturing a plurality of envelopes each having expanded slit sheet material in a peripheral wall of the envelope for protection of items within the envelope.

5. The system of claim 4, wherein said system is configured to provide wrapping of an item within the expanded slit sheet material for protection of the item.

6. A method of using the system of claim 5, comprising: wrapping an item with the expanded slit sheet material for protection of the item.

7. The system of claim 1, wherein said system is a wrapping system.

8. The system of claim 1, further including a controller for controlling the rotation of the at least two expansion rollers.

9. The system of claim 1, wherein said two adjacent expansion rollers are separated from one another by a distance greater than said thickness of said expandable slit sheet material and up to 140% of said thickness.

10. The system of claim 1, wherein said two adjacent expansion rollers are separated from one another by a distance greater than said thickness of said expandable slit sheet material and up to 160% of said thickness.

11. The system of claim 1, wherein said two adjacent expansion rollers are separated from one another by a distance greater than said thickness of said expandable slit sheet material and up to 180% of said thickness.

12. The system of claim 1, wherein said two adjacent expansion rollers are separated from one another by a distance greater than said thickness of said expandable slit sheet material and up to 200% of said thickness.

13. The system of claim 1, wherein said two adjacent expansion rollers are separated from one another by a distance greater than said thickness of said expandable slit sheet material and up to 240% of said thickness.

14. The system of claim 1, wherein said two adjacent expansion rollers are separated from one another by a distance greater than said thickness of said expandable slit sheet material and up to 260% of said thickness.

15. The system of claim 1, wherein said two adjacent expansion rollers are separated from one another by a distance greater than said thickness of said expandable slit sheet material and up to 300% of said thickness.

16. The system of claim 1, wherein said two adjacent expansion rollers are arranged such that the path of the expanded slit sheet material passing around each of said two adjacent expansion rollers includes the expanded slit sheet material contacting each of said two adjacent expansion rollers around respective arcs of at least 60 degrees around each of said adjacent expansion rollers.

17. The system of claim 1, wherein said two adjacent expansion rollers are arranged such that the path of the expanded slit sheet material passing around each of said two adjacent expansion rollers includes the expanded slit sheet material contacting each of said two adjacent expansion rollers around respective arcs of at least 90 degrees around each of said adjacent expansion rollers.

18. The system of claim 1, wherein said two adjacent expansion rollers are arranged such that the path of the expanded slit sheet material passing said one of said two adjacent expansion rollers includes the expanded slit sheet material contacting said one of said two adjacent expansion rollers around an arc of between 180 degrees and 270 degrees.

19. The system of claim 18, wherein said two adjacent expansion rollers are arranged such that the path of the expanded slit sheet material passing said other of said two adjacent expansion rollers includes the expanded slit sheet material contacting said other of said two adjacent expansion rollers around an arc of between 180 degrees and 270 degrees.

20. The system of claim 1, wherein said two adjacent expansion rollers are arranged such that the path of the expanded slit sheet material passing around each of said two adjacent expansion rollers includes the expanded slit sheet material contacting a most upstream one of said two adjacent expansion rollers around an arc of at least 40 degrees therearound.

21. The system of claim 1, wherein said two adjacent expansion rollers are arranged such that the path of the expanded slit sheet material passing around each of said two adjacent expansion rollers includes the expanded slit sheet material contacting a most upstream one of said two adjacent expansion rollers around an arc of at least 60 degrees therearound.

22. The system of claim 1, wherein said two adjacent expansion rollers are arranged such that the path of the expanded slit sheet material passing around each of said two adjacent expansion rollers includes the expanded slit sheet material contacting a most upstream one of said two adjacent expansion rollers around an arc of at least 90 degrees therearound.

23. The system of claim 1, further including a controller configured to rotate said at least one first roller at said first reduced rate and to rotate said at least two expansion rollers at said second rate that is faster than said first reduced rate, causing said expandable slit sheet material to expand due to the second rate being faster than said first reduced rate.

24. The system of claim 1, wherein said distance is greater than ½ inch.

25. The system of claim 1, wherein said distance is greater than 4 inches.

26. The system of claim 1, wherein said at least one of said two adjacent expansion rollers including a plurality of hooks distributed around a periphery thereof includes an upstream-most one of said two adjacent expansion rollers.

27. The system of claim 1, wherein said plurality of hooks distributed around the periphery of the at least one of said two adjacent expansion rollers are configured to extend across an entire width of the expandable slit sheet material.

28. A system having an expander for expanding and feeding an expandable slit sheet material with reduced damage to the expandable slit sheet material, comprising:

a) at least one first roller for feeding the expandable slit sheet material, said at least one first roller being adapted to rotate to move said expandable slit sheet material downstream at a first reduced rate;

b) at least two expansion rollers located downstream from the at least one first roller which receive the expandable slit sheet material from the at least one first roller, said at least two expansion rollers being adapted to rotate to move said expandable slit sheet material further downstream at a second rate that is faster than said first reduced rate, to cause said expandable slit sheet material to expand due to the second rate being faster than said first reduced rate;

c) said at least two expansion rollers including two adjacent expansion rollers arranged to adjacent one another, at least one of said two adjacent expansion rollers including a plurality of hooks distributed around a periphery thereof which are configured to engage slits of the expandable slit sheet material;

d) said two adjacent expansion rollers being separated from one another by a distance greater than a thickness of said expandable slit sheet material in an expanded state, such that the said two adjacent expansion rollers do not concurrently press against opposite sides of the expanded slit sheet material at a same longitudinal position of the expanded slit sheet material, wherein said two adjacent expansion rollers avoid damaging the expanded slit sheet material;

wherein said two adjacent expansion rollers are arranged such that a portion of the path of the expanded slit sheet material passing around said two adjacent expansion rollers is S-shape, with the path curving in a first direction around a periphery of one of said two adjacent expansion rollers and then in a second direction that is away from said first direction around a periphery of the other of said two adjacent rollers.

29. The system of claim 28, wherein said two adjacent expansion rollers are arranged such that the path of the expanded slit sheet material passing around each of said two adjacent expansion rollers includes the expanded slit sheet material contacting a most upstream one of said two adjacent expansion rollers around an arc of at least 40 degrees therearound.

30. The system of claim 28, wherein said two adjacent expansion rollers are arranged such that the path of the expanded slit sheet material passing around each of said two adjacent expansion rollers includes the expanded slit sheet material contacting a most upstream one of said two adjacent expansion rollers around an arc of at least 60 degrees therearound.

31. The system of claim 28, wherein said two adjacent expansion rollers are arranged such that the path of the expanded slit sheet material passing around each of said two adjacent expansion rollers includes the expanded slit sheet material contacting a most upstream one of said two adjacent expansion rollers around an arc of at least 90 degrees therearound.

32. The system of claim 28, wherein said two adjacent expansion rollers are separated from one another by a distance greater than said thickness of said expandable slit sheet material and up to 140% of said thickness.

33. The system of claim 28, wherein said two adjacent expansion rollers are separated from one another by a distance greater than said thickness of said expandable slit sheet material and up to 200% of said thickness.

34. The system of claim 28, wherein said two adjacent expansion rollers are separated from one another by a distance greater than said thickness of said expandable slit sheet material and up to 300% of said thickness.

35. The system of claim 28, wherein said plurality of hooks distributed around the periphery of the at least one of said two adjacent expansion rollers are arranged to extend across an entire width of the expandable slit sheet material.

36. The system of claim 35, wherein said two adjacent expansion rollers are arranged such that the path of the expanded slit sheet material includes the expanded slit sheet material contacting the at least one of said two adjacent expansion rollers that includes said plurality of hooks around an arc of at least 40 degrees therearound.

37. The system of claim 35, wherein said two adjacent expansion rollers are arranged such that the path of the expanded slit sheet material includes the expanded slit sheet material contacting the at least one of said two adjacent expansion rollers that includes said plurality of hooks around an arc of at least 60 degrees therearound.

38. The system of claim 35, wherein said two adjacent expansion rollers are arranged such that the path of the expanded slit sheet material includes the expanded slit sheet material contacting the at least one of said two adjacent expansion rollers that includes said plurality of hooks around an arc of at least 90 degrees therearound.

* * * * *